US010703118B2

(12) United States Patent
Hayashi

(10) Patent No.: US 10,703,118 B2
(45) Date of Patent: Jul. 7, 2020

(54) MEDIUM FEEDING APPARATUS

(71) Applicant: SEIKO EPSON CORPORATION, Tokyo (JP)

(72) Inventor: Toru Hayashi, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 128 days.

(21) Appl. No.: 15/453,313

(22) Filed: Mar. 8, 2017

(65) Prior Publication Data

US 2017/0267001 A1 Sep. 21, 2017

(30) Foreign Application Priority Data

Mar. 17, 2016 (JP) ..... 2016-053452

(51) Int. Cl.
*B41J 15/16* (2006.01)
*B65H 23/182* (2006.01)
(Continued)

(52) U.S. Cl.
CPC ..... *B41J 15/16* (2013.01); *B41J 15/165* (2013.01); *B65H 23/08* (2013.01); *B65H 23/182* (2013.01);
(Continued)

(58) Field of Classification Search
CPC ..... B65H 23/185; B65H 23/1825; B65H 23/182; B65H 23/08; B65H 23/085; B65H 16/103; B65H 59/387; B65H 2801/12; B65H 23/192; B65H 23/1888; B65H 2553/51; B65H 2701/175;
(Continued)

(56) References Cited

U.S. PATENT DOCUMENTS 8,159,159 B2 4/2012 Fernandez et al.
8,708,445 B2 * 4/2014 Hatada ..... B41J 11/001 347/101
9,539,831 B2 * 1/2017 Tanami ..... B41J 11/42
2009/0016797 A1 * 1/2009 Brugue ..... B41J 15/16 400/613
(Continued)

FOREIGN PATENT DOCUMENTS

JP 2004-292132 10/2004
JP 2013-216497 10/2013
JP 2015-231910 A 12/2015

OTHER PUBLICATIONS

Weighted Average—Definition, Formula & Examples; Weighted Average; Oct. 26, 2015; TutorVista.com; https://web.archive.org/web/20151026124401/https://math.tutorvista.conn/statistics/weighted-average.html (Year: 2015).*

*Primary Examiner* — Emmanuel M Marcelo
*Assistant Examiner* — Raveen J Dias
(74) *Attorney, Agent, or Firm* — Workman Nydegger

(57) ABSTRACT

A medium feeding apparatus includes a feeding roller which feeds a medium unwound from a roll body around which the medium is wound, a roll motor which applies torque for rotating the roll body to the roll body, and a roll control portion which controls the roll motor at the time of a feeding operation based on effective tension calculated by acquiring a feeding amount of the medium fed at each of a plurality of acquiring timings included in a pre-feeding operation, which is a feeding operation performed in advance, acquiring tension applied to the medium between the roll body and the feeding roller between a plurality of the acquiring timings, and weighting a plurality of the acquired tensions with the corresponding feeding amount.

2 Claims, 8 Drawing Sheets

(51) Int. Cl.

| | |
|---|---|
| ***B65H 23/08*** | (2006.01) |
| ***B65H 23/185*** | (2006.01) |
| *B41J 13/00* | (2006.01) |
| *B41J 11/00* | (2006.01) |

(52) U.S. Cl.
CPC ..... *B65H 23/185* (2013.01); *B65H 23/1825* (2013.01); *B41J 11/00* (2013.01); *B41J 13/00* (2013.01); *B65H 2513/11* (2013.01); *B65H 2801/12* (2013.01)

(58) Field of Classification Search
CPC ..... B65H 2404/143; B65H 2557/2644; B65H 2515/31; B65H 2557/246; B41J 15/16; B41J 15/165; B41J 15/04
USPC ..... 242/420, 420.1, 420.2, 450.3, 420.4, 242/420.5, 420.6
See application file for complete search history.

(56) References Cited

U.S. PATENT DOCUMENTS

2009/0121423 A1* 5/2009 Nakamura ..... B65H 16/028 271/275
2009/0226235 A1* 9/2009 Kobayashi ..... B41J 15/04 400/614
2009/0242603 A1* 10/2009 Kobayashi ..... B41J 15/02 226/179
2013/0120488 A1* 5/2013 Horie ..... B41J 11/007 347/16
2014/0152733 A1* 6/2014 Sano ..... H02P 7/29 347/16
2014/0239113 A1* 8/2014 Igarashi ..... B65H 23/1825 242/420.5
2015/0329310 A1 11/2015 Hayashi
2015/0375536 A1* 12/2015 Matsumura ..... B65H 23/1806 347/16

* cited by examiner

MEDIUM FEEDING APPARATUS

BACKGROUND

1. Technical Field

The present invention relates to a medium feeding apparatus which feeds a medium from a roll body around which the medium is wound.

2. Related Art

Recently, a medium feeding apparatus, which is provided with a feeding roller feeding a medium unwound from a roll body, a roll motor applying torque for rotating the roll body to the roll body, and a roll motor control portion controlling the roll motor, is known. The roll motor control portion feedback-controls the roll motor by calculating tension applied to a medium between the roll body and the feeding roller at the time of a previous feeding operation so that the calculated tension comes up to target tension. Accordingly, a slipping amount of the medium with respect to the feeding roller is controlled, and the medium is fed as a desired feeding amount. The roll motor control portion calculates the tension based on average tension corresponding to an average value of current flowing the feeding motor at the time of the previous feeding operation and peak tension corresponding to a maximum value of the same current (refer to JP-A-2015-231910).

In a case in which correlativity of the calculated tension and the slipping amount of the medium is low, even when the calculated tension is controlled to come up to the target tension, the slipping amount of the medium is deviated from a desired slipping amount, and as a result, a feeding amount of the medium is deviated from a desired feeding amount.

SUMMARY

An advantage of some aspects of the invention is to provide a medium feeding apparatus, which is capable of suppressing deviation of the feeding amount of the medium from the desired feeding amount.

A medium feeding apparatus according to an aspect of the invention includes a feeding portion that feeds a medium unwound from a roll body around which the medium is wound, a roll driving portion that applies torque for rotating the roll body to the roll body, and a roll control portion that controls the roll driving portion at the time of a feeding operation based on effective tension calculated by acquiring a plurality of feeding amounts of the medium fed in every acquiring timing included in a pre-feeding operation which is a feeding operation performed in advance, acquiring tension applied to the medium between the roll body and the feeding portion between a plurality of the acquiring timings, and weighting a plurality of the acquired tensions with the corresponding feeding amount.

According to this configuration, each tension weighted with the corresponding feeding amount has high correlativity with a slipping amount of the medium while the medium is fed as the feeding amount. Therefore, the calculated effective tension has high correlativity with the slipping amount of the medium in one time of feeding operation. Also, the slipping amount of the medium with respect to the feeding portion can be appropriately controlled by controlling the roll driving portion based on the effective tension, and deviation of the feeding amount of the medium from the desired feeding amount can be suppressed.

In this case, it is preferable that the roll control portion weight the plurality of tension by collecting the multiplied value of each tension and the feeding amount corresponding to each tension, and dividing the collected value by a total amount of the plurality of feeding amounts.

According to the configuration, the roll control portion is capable of calculating the effective tension by collecting the multiplied value of each tension and the feeding amount corresponding to each tension, and dividing the collected value by the total amount of the plurality of feeding amounts.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a recording apparatus 10 which is an embodiment of a medium feeding apparatus of the invention will be described with reference to attached drawings.

Figure 1:
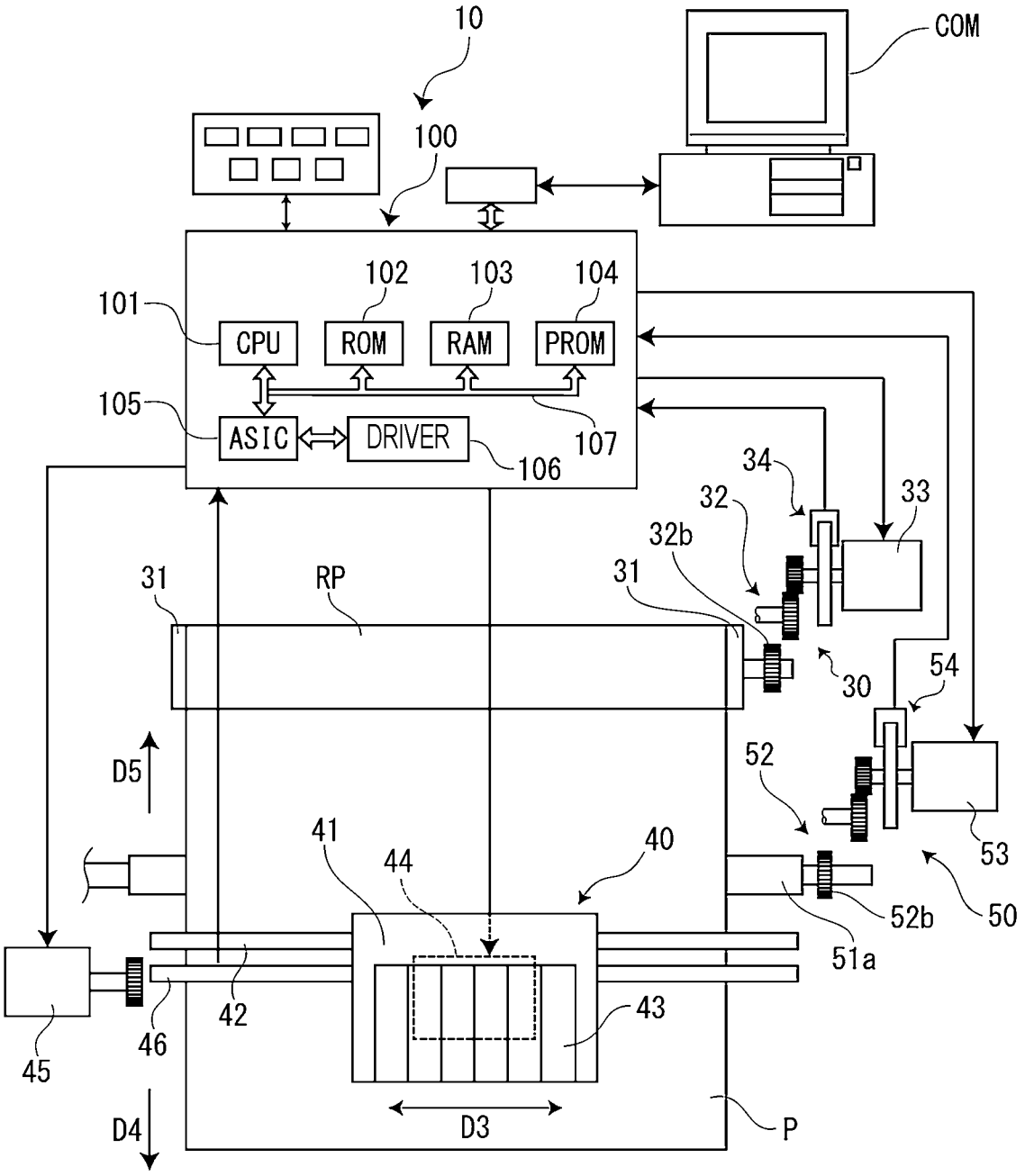
FIG. 1 is a view illustrating a schematic configuration of a recording apparatus according to an embodiment of the invention.
Figure 2:
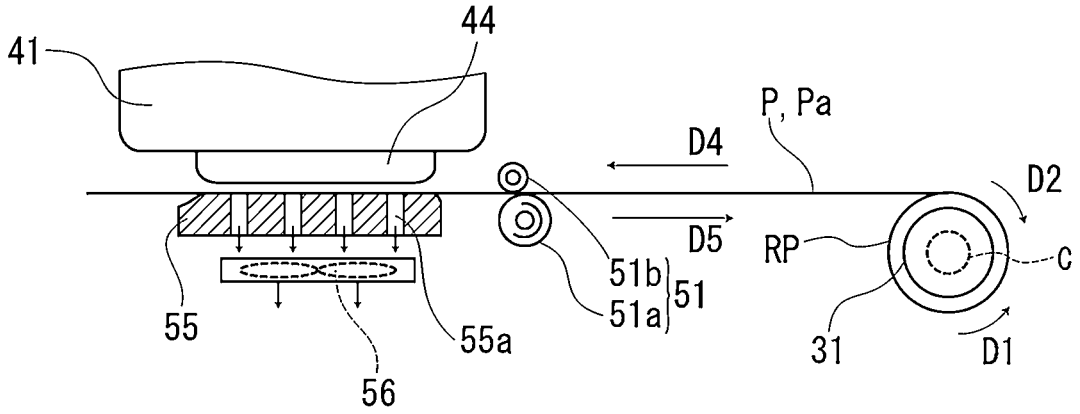
FIG. 2 is a view illustrating a position relationship of a roll body, a feeding roller, and a recording head.

Based on FIG. 1 and FIG. 2, a schematic configuration of the recording apparatus 10 will be described. The recording apparatus 10 prints an image by an ink jet manner with respect to a medium P while the medium P is unwound from a roll body RP. In addition, the roll body RP set in the recording apparatus 10 is a roll body in which the long shaped medium P is wound around the core C (for example, paper tube). Also, as the medium P, for example, various materials such as paper, films, and fabrics are used. A maximum width, a maximum diameter, a maximum weight of the roll body RP which can be set in the recording apparatus 10 are respectively, for example, 64 inches (substantially 1.6 m), 250 mm, and 80 kg.

The recording apparatus 10 is provided with a roll driving mechanism 30, a carriage driving mechanism 40, a medium feeding mechanism 50, a platen 55, and a controller 100.

The roll driving mechanism 30 rotates the roll body RP. The roll driving mechanism 30 is provided with a pair of rotation holders 31, a roll gear train 32, a roll motor 33, and a roll rotation detecting portion 34.

The pair of rotation holders 31 is inserted into both ends of the core C of the roll body RP, and held by the both ends of the roll body RP. The rotation holder 31 is supported to be capable of being rotated by a holder supporting portion which is not illustrated. In one rotation holder 31, the roll inputting gear 32*b*, which is engaged with a roll outputting gear (not illustrated) of the roll gear train 32, is provided.

The roll motor 33 applies torque for rotating the roll body RP to the roll body RP through the rotation holder 31 in which the roll inputting gear 32*b* is provided. As the roll motor 33, for example, a direct current (DC) motor can be used. When a driving force from the roll motor 33 is transferred to the rotation holder 31 through the roll gear train 32, the rotation holder 31 and the roll body RP held by the rotation holder 31 are rotated. When the roll motor 33 is rotated in a one reverse direction, the roll body RP is rotated in an unwinding direction D1 so that the medium P is unwound from the roll body RP. In addition, when the roll motor 33 is rotated in another reverse direction, the roll body RP is rotated in a rewinding direction D2 so that the medium P is rewound to the roll body RP.

The roll rotation detecting portion 34 detects a rotation amount of the roll body RP. The roll rotation detecting portion 34 is a rotary encoder which includes a disk shaped scale provided on an output shaft of the roll motor 33 and a photo-interrupter. As a counter value of an output pulse from the roll rotation detecting portion 34, a rotation position of the roll body RP is shown, and an amount of change of the rotation position of the roll body RP is set to the rotation amount of the roll body RP.

The carriage driving mechanism 40 reciprocates a carriage 41 in which the recording head 44 is mounted in a movement direction D3. The carriage driving mechanism 40 is provided with the carriage 41, a carriage shaft 42, a carriage motor 45, and a carriage position detecting portion 46.

The carriage 41 is supported by the carriage shaft 42 so as to be movable along the carriage shaft 42. In the carriage 41, and ink tanks 43 of a plurality of colors are provided. In the ink tank 43, ink is supplied from the ink cartridge which is not illustrated through a tube. In addition, on a lower surface of the carriage 41, the recording head 44 which is an ink jet head is provided. The recording head 44 discharges the ink from nozzles with respect to the medium P.

The carriage motor 45 is a driving source for moving the carriage 41 along the carriage shaft 42 in the movement direction D3. When a driving force of the carriage motor 45 is transferred to the carriage 41 through a belt mechanism which is not illustrated, the carriage 41 is moved in the movement direction D3.

The carriage position detecting portion 46 detects a position in the movement direction D3 of the carriage 41. The carriage position detecting portion 46 is a linear encoder which is provided with a linear scale provided along the movement direction D3 and a photo-interrupter.

The medium feeding mechanism 50 feeds the medium P unwound from the roll body RP. The medium feeding mechanism 50 is provided with a feeding roller 51, a feeding gear train 52, a feeding motor 53, and a feeding rotation detecting portion 54.

The feeding roller 51 is provided with a driving roller 51*a* and an accompanied roller 51*b*. The driving roller 51*a* and the accompanied roller 51*b* feed the medium P sandwiched between each other. In the driving roller 51*a*, a feeding inputting gear 52*b* engaged with a feeding outputting gear (not illustrated) of the feeding gear train 52 is provided.

The feeding motor 53 is a driving source for rotating the driving roller 51*a*. The feeding motor 53 is, for example, a DC motor. When a driving force from the feeding motor 53 is transferred to the driving roller 51*a* through the feeding gear train 52, the driving roller 51*a* is rotated, according to this, the accompanied roller 51*b* is rotated. When the feeding motor 53 is rotated in the one reverse direction, the medium P is fed in a feeding direction D4 substantially orthogonal to the movement direction D3. In addition, when the feeding motor 53 is rotated in another reverse direction, the medium P is fed in the reverse-feeding direction D5 which is reversed direction of the feeding direction D4.

The feeding rotation detecting portion 54 detects a rotation amount of the driving roller 51*a*. The feeding rotation detecting portion 54 is a rotary encoder which includes a disk shaped scale provided on an output shaft of the feeding motor 53 and a photo-interrupter. As a counter value of an output pulse from the feeding rotation detecting portion 54, a rotation position of the driving roller 51*a* is shown, and an amount of change of the rotation position of the driving roller 51*a* is set to a rotation amount of the driving roller 51*a*.

The platen 55 is provided to face the recording head 44 in a downstream side of a feeding passage Pa further than the driving roller 51*a*. In the platen 55, a plurality of suction holes 55*a* vertically penetrating the platen are formed. In addition, a suction fan 56 is formed on a lower side of the platen 55. When the suction fan 56 is operated, an inside of the suction hole 55*a* is negatively pressurized, and the medium P on the platen 55 is sucked and held. Ink is discharged from the recording head 44 with respect to the medium P sucked and held on the platen 55.

The controller 100 controls each portion of the recording apparatus 10 overall. The controller 100 is provided with a central processing unit (CPU) 101, a read only memory (ROM) 102, a random access memory (RAM) 103, a programmable ROM (PROM) 104, an application specific integrated circuit (ASIC) 105, a motor driver 106, and a bus 107. The functional configuration of the controller 100 will be described later.

In addition, the controller 100 is connected to be capable of communicating with a computer COM which is an external device. The controller 100 controls each portion of the recording apparatus 10 based on a received recording job when receiving the recording job from the computer COM. Accordingly, the recording apparatus 10 alternately repeats a dot forming operation and the feeding operation. Here, the dot forming operation is an operation in which ink is discharged from the recording head 44 and forms dots on the medium P while the carriage 41 is moved in the movement direction D3, and it is called a main scanning. The feeding operation is an operation in which the medium P is fed in the feeding direction D4, and it is called a sub scanning.

Figure 3:
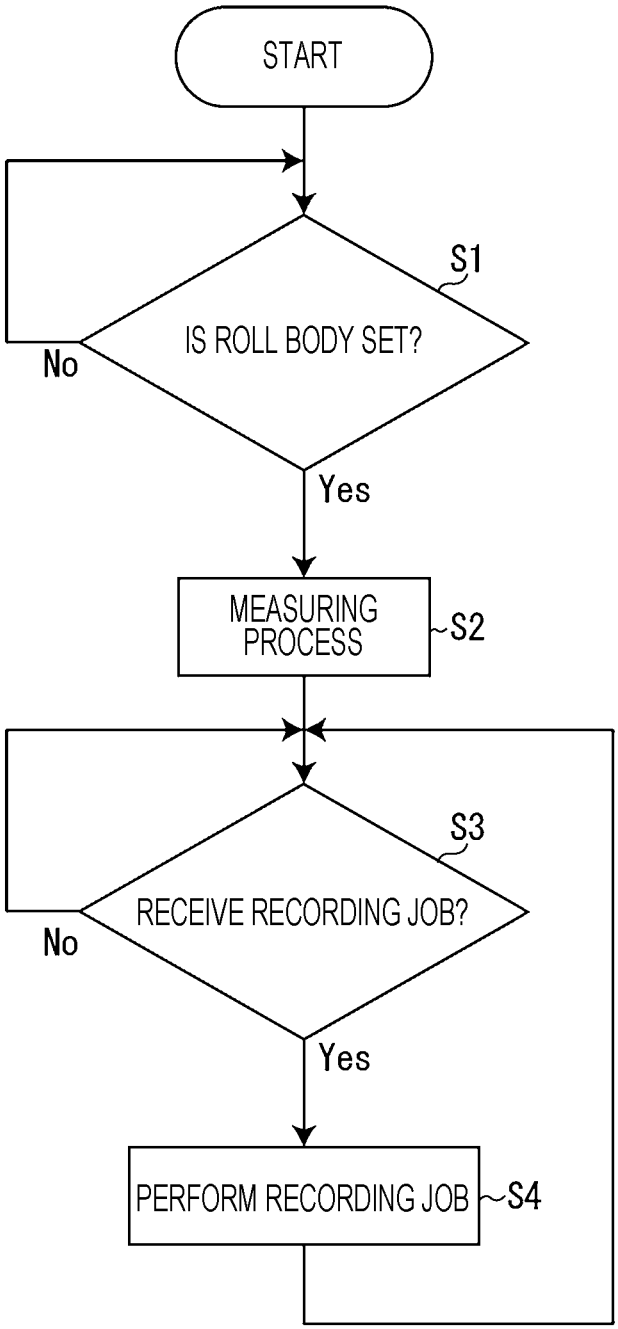
FIG. 3 is a flow chart illustrating flowing of the entire process of the recording apparatus.

Based on FIG. 3, flowing of a basic process in the recording apparatus 10 will be described. In Step S1, the controller 100 determines whether or not the roll body RP is set in the recording apparatus 10. The controller 100 may determine whether or not the roll body RP is set in the recording apparatus 10, for example, based on an operation with respect to an operation panel which is not illustrated, or based on a detected result by a sensor which is not illustrated. The controller 100 proceeds a progress to Step S2, when determining that the roll body RP is set in the recording apparatus 10 (Yes in S1).

In Step S2, the controller 100 performs a measuring process. In the measuring process, a roll diameter Rr, a first torque N1, and a second torque N2 are measured. The roll diameter Rr is a radius of the roll body RP. The first torque N1 is torque (load applied to roll motor 33) of the roll motor 33 which is necessary for rotating the roll body RP at a first rotation speed V1. The second torque N2 is torque of the roll motor 33 which is necessary for rotating the roll body RP at a second rotation speed V2 faster than the first rotation speed V1. A measuring method of the roll diameter Rr, the first torque N1, and the second torque N2 will be described.

Figure 6:
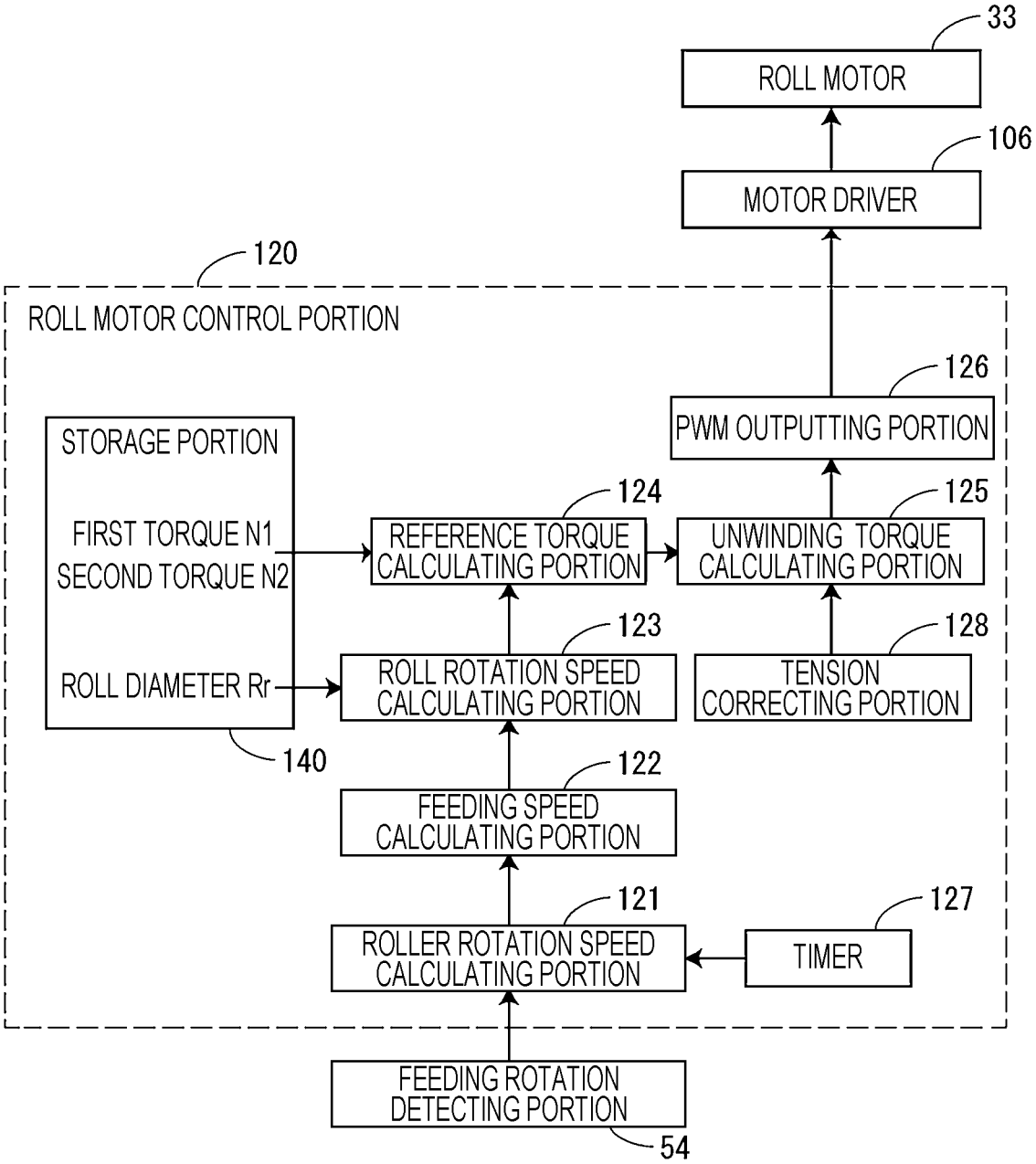
FIG. 6 is a block diagram illustrating the functional configuration of a roll motor control portion.

When the measuring process is finished, the measured roll diameter Rr, first torque N1, and second torque N2 are stored in a storage portion 140 (refer to FIG. 6). The storage portion 140 is configured with, for example, a PROM 104.

In Step S3, the controller 100 determines whether or not the recording job is sent from the computer COM. The controller 100 proceeds the progress to Step S4 when determining that the recording job is sent from the computer COM (Yes in S3).

In Step S4, the controller 100 performs the recording job. Detail will be described later, the controller 100 controls the roll motor 33 based on the roll diameter Rr, the first torque N1, and the second torque N2 stored in the storage portion 140, at the time of the feeding operation in the recording job. When the recording job is finished, the progress returns to Step S3.

Here, the measuring method of the roll diameter Rr, the first torque N1, and the second torque N2 will be described. First, the controller 100 operates only the feeding motor 53, in a state in which the medium P is not slacked, without operating the roll motor 33. In a case in which the medium P is fed as described above, it is thought that a feeding amount of the medium P by the feeding roller 51, and a feeding amount of the medium P unwound from the roll body RP which is pulled and rotated by the feeding roller 51 through the medium P are equal to each other. Therefore, the controller 100 calculates the roll diameter Rr based on a rotation amount of the driving roller 51*a* detected by the feeding rotation detecting portion 54, a diameter of the driving roller 51*a* which is known, and a rotation amount of the roll body RP detected by the roll rotation detecting portion 34.

Subsequently, the controller 100 operates the roll motor 33 so that the roll body RP is rotated in the unwinding direction D1 at the first rotation speed V1. The controller 100 acquires a duty value being output to the roll motor 33 as the first torque N1 at the time when the rotation speed V of the roll body RP is stabled at the first rotation speed V1. Subsequently, the controller 100 operates the roll motor 33 so that the roll body RP is rotated in the unwinding direction D1 at the second rotation speed V2. The controller 100 acquires a duty value output to the roll motor 33 as the second torque N2 at the time when the rotation speed V of roll body RP is stabled at the second rotation speed V2.

Moreover, the roll diameter Rr is reduced in accordance with feeding of the medium P when the recording job is performed. Therefore, it is preferable that the controller 100 corrects the roll diameter Rr recorded in the storage portion 140 in a second or later recording job after the roll body RP is set, based on a feeding amount of the medium P in a previous recording job. In addition, the first torque N1 and the second torque N2 have a corresponding relationship with the roll diameter Rr. Therefore, it is preferable that the controller 100 correct the first torque N1 and the second torque N2 recorded in the storage portion 140 in a second or later recording job after the roll body RP is set, based on the corrected roll diameter Rr. Further, the controller 100 may correct the roll diameter Rr, the first torque N1, and the second torque N2 in real time during performing the recording job.

Figure 4:
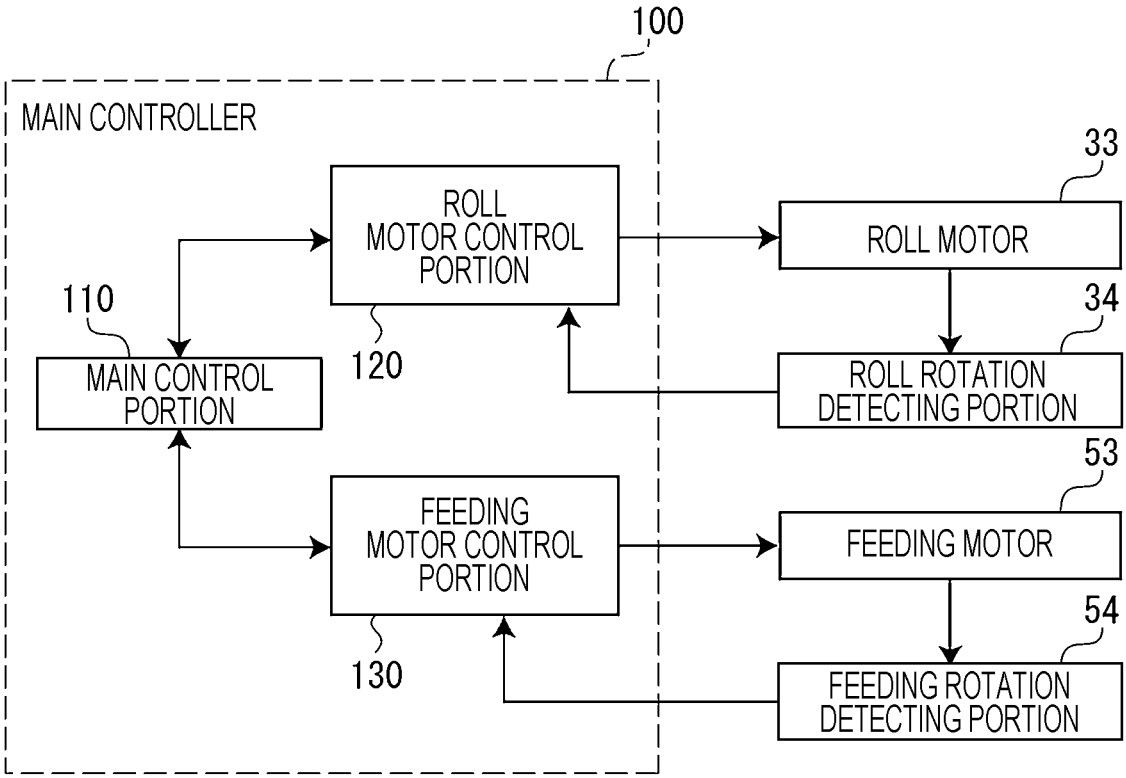
FIG. 4 is a block diagram illustrating a functional configuration of a controller.

Based on FIG. 4, the functional configuration of the controller 100 will be described. The controller 100 is provided with a main control portion 110, a roll motor control portion 120, and a feeding motor control portion 130. Each functional portion illustrated in FIG. 4, and FIG. 6 and FIG. 8 to be described later is realized when a hardware constituting the controller 100 is cooperated with a software stored in a memory such as the ROM 102.

The main control portion 110 gives a command to the roll motor control portion 120 and the feeding motor control portion 130. The main control portion 110 is capable of giving commands to the roll motor control portion 120 and the feeding motor control portion 130 so that the roll motor 33 and the feeding motor 53 are respectively and independently driven, and the roll motor 33 and the feeding motor 53 are driven to be synchronized.

The feeding motor control portion 130 performs a speed PID control in a front converting position as a predetermined amount further than a target stop position, at the time of the feeding operation, and after reaching the converting position, the control portion performs a position PID control. The feeding motor control portion 130 controls the feeding motor 53 at the time of the speed PID control based on a speed deviation of the rotation speed (current speed) and a target speed which are calculated from a rotation position of the driving roller 51*a* detected by the feeding rotation detecting portion 54. In addition, the feeding motor control portion 130 controls the feeding motor 53 at the time of the position PID control based on a position deviation of a rotation position (current position) and a target stop position of the driving roller 51*a* detected by the feeding rotation detecting portion 54.

Figure 5:
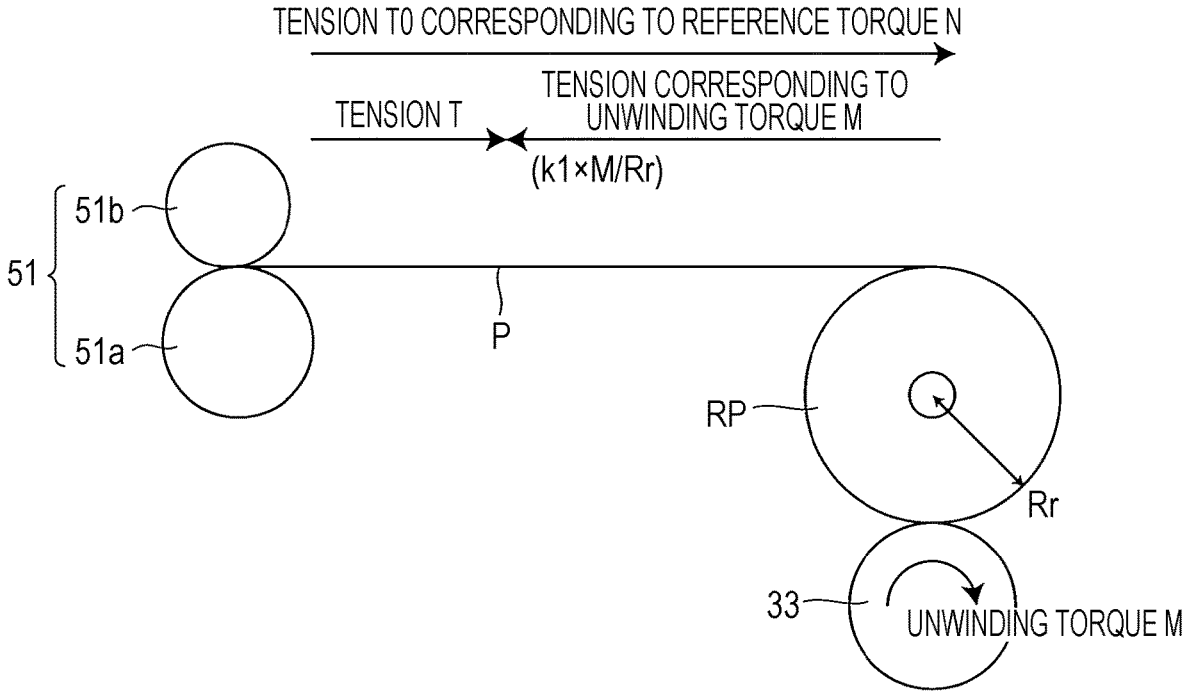
FIG. 5 is a diagram for describing a basic thought relating to a control method of a roll motor.

Based on FIG. 5, a basic thought of a control method of the roll motor 33 by the roll motor control portion 120 will be described. If the recording apparatus 10 operates only the feeding motor 53 at the time of the feeding operation, without operating the roll motor 33, the medium P is fed. In this case, tension T0 applied to the medium P between the roll body RP and the feeding roller 51 can be indicated by Expression (1) using the reference torque N which is torque of the roll motor 33 necessary for rotating the roll body RP.

$$T0=k1\times N/Rr \tag{1}$$

Moreover, k1 is a proportional constant which is determined by a reduction ratio, or the like of the roll gear train 32.

Here, in a case in which the tension T0 is great, the feeding roller 51 is idled with respect to the medium P, and the medium P cannot be fed as a desired feeding amount of feeding. Therefore, the roll motor control portion 120 generates an unwinding torque M, which reduces the tension T applied to the medium P between the roll body RP and the feeding roller 51, in the roll motor 33 at the time of the feeding operation. In this case, the tension T applied to the medium P between the roll body RP and the driving roller 51*a* can be indicated by Expression (2).

$$T=k1\times(N-M)/Rr \tag{2}$$

Based on FIG. 6, the functional configuration of the roll motor control portion 120 will be described. The roll motor control portion 120 is provided with a roller rotation speed calculating portion 121, a feeding speed calculating portion 122, a roll rotation speed calculating portion 123, a reference torque calculating portion 124, an unwinding torque calculating portion 125, a PWM outputting portion 126, and a timer 127. In addition, detail will be described later, the roll motor control portion 120 further includes a tension correcting portion 128.

The roller rotation speed calculating portion 121 calculates a rotation speed of the driving roller 51*a* based on a rotation amount of the driving roller 51*a* detected by the feeding rotation detecting portion 54, and a time measured by the timer 127.

The feeding speed calculating portion 122 calculates a feeding speed of the medium P based on a rotation speed of the driving roller 51*a* calculated by the roller rotation speed calculating portion 121 and a known diameter of the driving roller 51*a*.

The roll rotation speed calculating portion 123 calculates the rotation speed V of the roll body RP based on a feeding speed of the medium P calculated by the feeding speed calculating portion 122, and the roll diameter Rr stored in the storage portion 140.

The reference torque calculating portion 124 calculates the reference torque N which is torque of the roll motor 33 necessary for rotating the roll body RP at the rotation speed V calculated by the roll rotation speed calculating portion 123.

Figure 7:
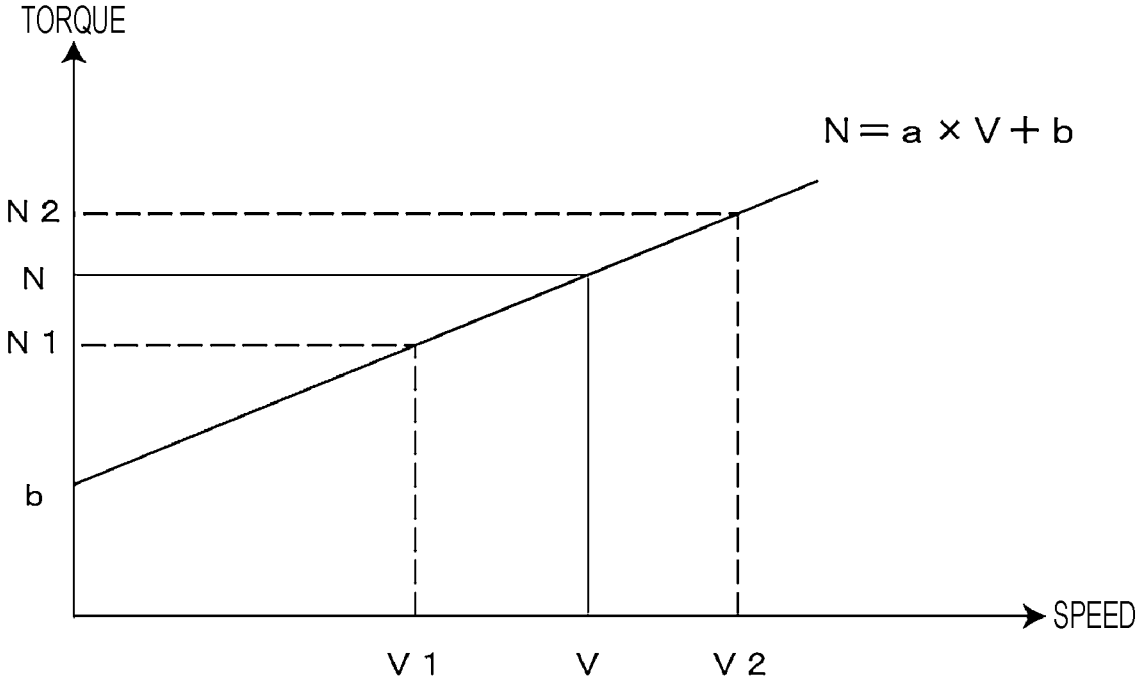
FIG. 7 is a graph illustrating a relationship of a rotation speed V of the roll body and a reference torque N of the roll motor necessary for rotating the roll body.

As illustrated in FIG. 7, the reference torque N includes a linear corresponding relationship of the rotation speed V of the roll body RP. That is, when the first torque N1 corresponding to the first rotation speed V1 and the second torque N2 corresponding to the second rotation speed V2 are known, an inclination a and an intercept b of an approximate curve (N=a×V+b) are determined. Therefore, the reference torque calculating portion 124 calculates the reference torque N corresponding to the rotation speed V of the roll body RP by a linear interpolation based on the first torque N1 and the second torque N2.

The unwinding torque calculating portion 125 calculates the unwinding torque M of the roll motor 33 by substituting the reference torque N calculated by the reference torque calculating portion 124, a target tension Ta, the roll diameter Rr stored in the storage portion 140, and the known proportional constant k1 for Expression (3) derived from Expression (2).

$$M=N-\{(T\times Rr)/k1\} \quad (3)$$

Moreover, detail will be described later, the unwinding torque calculating portion 125 calculates the unwinding torque M by the tension correcting portion 128 using a corrected tension Tb of which the target tension Ta is corrected.

The PWM outputting portion 126 outputs a PWM signal of a duty value which is proportional to the calculated unwinding torque M, to the motor driver 106. The motor driver 106 drives the feeding motor 53 by PWM controlling based on the output PWM signal. Accordingly, the feeding motor 53 is operated so that the target tension Ta is applied to the medium P between the roll body RP and the feeding roller 51.

However, in actual feeding operation, the reference torque N is changed during one time of rotation of the roll body RP due to eccentricity of the roll body RP, or a frictional force of the medium P and a member constituting the feeding passage Pa is varied due to a difference of the medium P. In such a case, even when the roll motor control portion 120 controls the feeding motor 53 based on the unwinding torque M calculated by Expression (3), the tension T applied to the medium P between the roll body RP and the feeding roller 51 is deviated from the target tension Ta.

Here, the roll motor control portion 120 calculates effective tension Te to be described later as the tension T applied to the medium P between the roll body RP and the feeding roller 51, and controls tension FB (feedback) so that the calculated effective tension Te comes up to the target tension Ta. Specifically, the tension correcting portion 128 of the roll motor control portion 120 calculates the effective tension Te, corrects the target tension Ta based on the calculated effective tension Te, and outputs a corrected target tension Ta, that is, the corrected tension Tb to the unwinding torque calculating portion 125.

Figure 8:
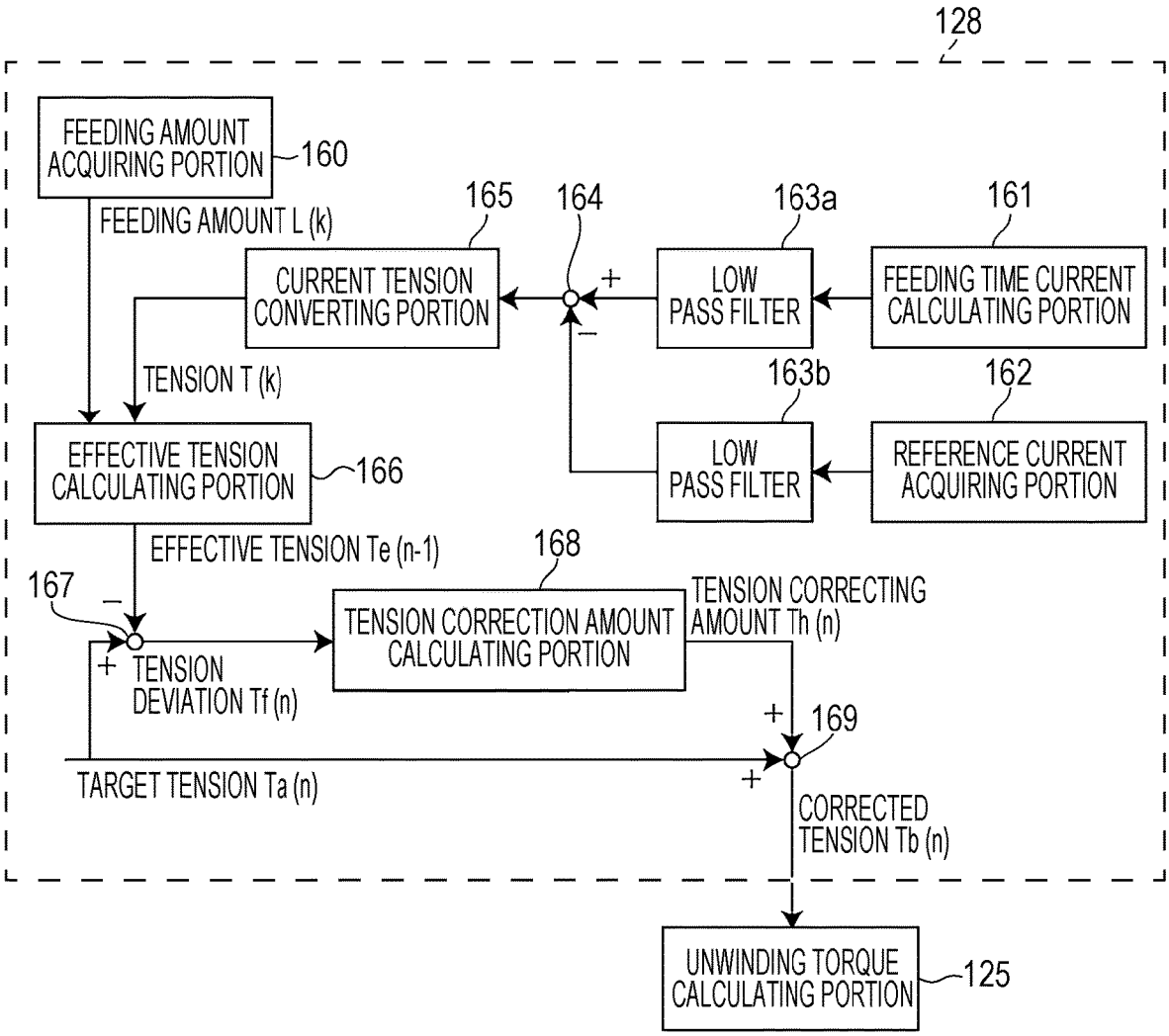
FIG. 8 is a block diagram illustrating a functional configuration of a tension correcting portion.

Based on FIG. 8, the tension correcting portion 128 will be described. The tension correcting portion 128 is provided with a feeding amount acquiring portion 160, a feeding time current calculating portion 161, a reference current acquiring portion 162, low pass filters 163*a* and 163*b*, a current reducing portion 164, a current tension converting portion 165, effective tension calculating portion 166, a tension subtracting portion 167, a tension correction amount calculating portion 168, and a tension adding portion 169.

The feeding amount acquiring portion 160 acquires a feeding amount L (k) of which the medium P is fed at an acquiring timing of a predetermined cycle (for example, 1 msec cycle) based on a detected result of the feeding rotation detecting portion 54. Here, the feeding amount L (k) means the feeding amount of which the medium P is fed from an acquiring timing of (k−1)-th to an acquiring timing of k-th.

At the time of the feeding operation, the feeding time current calculating portion 161 calculates a current Ia at the time of feeding which is a current flowing the feeding motor 53, at the same timing as the acquiring timing when the feeding amount L (k) is acquired. The current Ia at the time of feeding acquired at the acquiring timing of the k-th is indicated by Ia (k). The calculated current Ia (k) at the time of feeding is input to the current reducing portion 164 through the low pass filter 163*a*.

The reference current acquiring portion 162 acquires a reference current Ib stored in the storage portion 140. The reference current Ib is current flowing the feeding motor 53, before starting the recording job, in a state in which the medium P is slacked, in a case in which the feeding motor 53 is driven at the same rotation speed and the driving time as the speed and time when the feeding operation is performed. The reference current Ib is calculated at a timing corresponding to the acquiring timing when the current Ia at the time of feeding is calculated. The reference current Ib calculated at the acquiring timing of the k-th is indicated by Ib (k). The reference current Ib (k) is input to the current reducing portion 164 through the low pass filter 163*b*. Moreover, it is preferable that the reference current acquiring portion 162 input an average value of the reference currents Ib (k), which are calculated in multiple in each recording job, to the current reducing portion 164.

Here, a current I flowing the feeding motor 53 can be calculated by Expression (4).

$$I=(E\times \mathrm{Duty}-Ke\times\omega)/RR \quad (4)$$

E: power source voltage

Duty: PWM control value being output to feeding motor 53

Ke: inverse electromotive force constant of feeding motor 53

ω: rotation speed of feeding motor 53

RR: resistance of feeding motor 53

Moreover, since the inverse electromotive force constant Ke or the resistance RR of the feeding motor 53 is changed due to temperature, these may be corrected.

The current reducing portion 164 calculates tension current Ic (k) of which the reference current Ib (k) subtracted from the current Ia (k) at the time of feeding.

The current tension converting portion 165 converts the tension current Ic (k) to tension T (k) applied to the medium P between the roll body RP and the feeding roller 51 by Expression (5).

$$T(k)=Ic(k)\times Kt\times Z/Rk \quad (5)$$

Kt: torque constant of feeding motor 53

Z: reduction ratio of feeding gear train 52

Rk: radius of driving roller 51*a*

As described above, the roll motor control portion 120 acquires the tension T (k) in the k-th acquiring timing, between the plurality of acquiring timings included in one time of feeding operation, that is, from a (k−1)-th acquiring timing to the k-th acquiring timing, as the tension applied to the medium P between the roll body RP and the feeding roller 51. Accordingly, "between the plurality of acquiring timings" means that the acquiring timing itself is included therein.

The effective tension calculating portion 166 calculates the effective tension Te based on a plurality of tensions T (k), and a plurality of the feeding amounts L (k). A specific calculating method of the effective tension Te will be described later.

The tension subtracting portion 167 calculates tension deviation Tf (n), which is a deviation between a tension T (n−1) output from the effective tension calculating portion 166 and a target tension Ta (n) commanded from the main control portion 110.

Moreover, Te (n−1) means effective tension Te calculated in the feeding operation of (n−1)-th. Hereinafter, it is the same to the target tension Ta (n), or the like.

The tension correction amount calculating portion 168 calculates a tension deviation integral value Tg (n) obtained by integrating the tension deviation Tf (n) output from the tension subtracting portion 167 by Expression (6). Further, the tension correction amount calculating portion 168 calculates a tension correcting amount Th (n) by Expression (7).

$$Tg(n)=Tg(n-1)+Tf(n) \tag{6}$$

$$Th(n)=Tg(n)\times G \tag{7}$$

Here, G is a gain.

Moreover, the tension deviation integral value Tg is initialized, that is cleared to be zero based on any one of attachment of the roll body RP, change of the target tension Ta, and change of feeding speed of the medium P as a trigger.

The tension adding portion 169 adds the target tension Ta (n) commanded from the main control portion 110 to the tension correcting amount Th (n) output from the tension correction amount calculating portion 168, and outputs a total corrected tension Tb (n) to the unwinding torque calculating portion 125.

As a result, the unwinding torque calculating portion 125 calculates the unwinding torque M output at the time of n-th feeding operation based on the corrected tension Tb (n). Accordingly, the roll motor control portion 120 controls the roll motor 33 at the time of the n-th feeding operation based on the calculated effective tension Te (n−1).

However, a slipping amount of the medium P which is slipped with respect to the feeding roller 51 in a period from the (k−1)-th acquiring timing to the k-th acquiring timing is changed by not only the tension T (k) applied to the medium P between the roll body RP and the feeding roller 51 in this period but also the feeding amount L (k) of the medium P fed in the period. In addition, a tension waveform, which indicates a change of tension T applied to the medium P between the roll body RP and the feeding roller 51 in one time of the feeding operation, may be changed in accordance with a feeding amount, a feeding speed, a roll diameter Rr, and the like in one time of the feeding operation. In this case, if the effective tension calculating portion 166 calculates the effective tension Te based on an average value and a peak value of a plurality of the tensions T (k), the effective tension Te has not sufficient high correlativity with the slipping amount of the medium P.

In other words, even when an average value and a peak value of the plurality of tensions T (k) are equal, in a case in which the tension waveforms are different, the slipping amount of the medium P becomes different. For example, in the feeding operation of the tension waveform where the tension T is high when the feeding amount of the medium P is great per unit time (when the feeding speed of the medium P is fast), the slipping amount of the medium P in one time of feeding operation is increased. On the other hand, in the feeding operation of the tension waveform where the tension T is high when the feeding amount of the medium P is small per unit time (when the feeding speed of the medium P is slow), the slipping amount of the medium P in one time of feeding operation is decreased.

Also, in a case in which correlativity between the calculated effective tension Te and the slipping amount of the medium P is not sufficiently high, even when control is performed so that the calculated effective tension Te comes up to the target tension Ta, the slipping amount of the medium P is deviated from a desired slipping amount, and as a result, the feeding amount of the medium P is deviated from a desired feeding amount.

Here, the effective tension calculating portion 166 calculates the effective tension Te by weighting the plurality of tensions T (k) with the corresponding feeding amount L (k). That is, as illustrated in Expression (8), the effective tension calculating portion 166 collects values obtained by multiplying each tension T (k) and the corresponding feeding amount (k), divides the collected values by a total feeding amount Lt which is a total amount of the plurality of feeding amounts L (k), and thus weights the plurality of tension T (k).

$$Te=\frac{\Sigma_{k=1}^{p}T(k)\times L(k)}{Lt} \tag{8}$$

Moreover, in Expression (8), p is a detection frequency of the tension T (k) in one time of feeding operation.

Here, the multiplied values (T (k)×L (k)) of each tension T (k) and the corresponding feeding amount L (k) have a high correlativity with the slipping amount of the medium P during feeding the medium P only in the feeding amount L (k). Therefore, these are collected, the effective tension Te, which is a value obtained by dividing the collected values by the total feeding amount Lt, has also high correlativity with the slipping amount of the medium P while only the total feeding amount Lt of the medium P is fed, that is, in one time of feeding operation.

As described above, the recording apparatus 10 of the embodiment is provided with the feeding roller 51, the roll motor 33, and the roll motor control portion 120. The feeding roller 51 feeds the medium P unwound from the roll body RP around which the medium P is wound. The roll motor 33 applies torque for rotating the roll body RP to the roll body RP. The roll motor control portion 120 acquires the feeding amount L (k) of the medium P, which is fed, at each of a plurality of the acquiring timings included in the pre-feeding operation, which is a feeding operation performed in advance. In addition, the roll motor control portion 120 acquires the tension T (k) applied to a medium between the roll body RP and the feeding roller 51 between the plurality of acquiring timings. Also, the roll motor control portion 120 calculates the effective tension Te by weighting the acquired the plurality of tensions T (k) using the corresponding feeding amount L (k), and controls the roll motor 33 at the time of the feeding operation based on the effective tension Te.

According to this configuration, each weighted tension T (k) using the corresponding feeding amount L (k) has a high correlativity with the slipping amount of the medium P while the feeding amount L (k) of the medium P is fed. Therefore, the calculated effective tension Te has a high correlativity with the slipping amount of the medium P in one time of feeding operation. Also, when the roll motor 33 is controlled on the basis of the effective tension Te, the slipping amount of the medium P with respect to the feeding roller 51 can be appropriately controlled, and deviation of the feeding amount of the medium P from a desired feeding amount can be suppressed. In addition, accordingly, deviation of a length of printing from a desired length of printing can be suppressed.

In addition, in the recording apparatus 10 of the embodiment, when the roll motor control portion 120 collects the multiplied value of each tension T (k) to the feeding amount L (k) corresponding to each tension T (k), and divides the collected value by the total feeding amount Lt, the plurality of tensions T (k) are weighted.

According to this configuration, when the roll motor control portion 120 collects the multiplied value of each tension T (k) to the corresponding feeding amount L (k), and divides the collected value by the total feeding amount Lt, the effective tension Te can be calculated.

Moreover, the roll motor 33 is an example of a "roll driving portion". The feeding roller 51 is an example of a "feeding portion". The roll motor control portion 120 is an example of a "roll control portion".

The invention is not limited to the above described embodiment, and it is needless to say that various configuration can be adopted hereto in a range without departing from a purpose of the invention. For example, the embodiment can be changed to an embodiment as follows.

The roll motor control portion 120 may acquire a target value of the feeding amount of the medium P at each acquiring timing stored in the storage portion 140, as the feeding amount L (k), instead of the feeding amount of the medium P detected by the feeding rotation detecting portion 54. In addition, the roll motor control portion 120 may acquire a measured value of a tension measurer provided between the roll body RP and the feeding roller 51, instead of the value calculated from the current Ia (k) at the time of feeding, as the tension T (k).

The roll motor control portion 120 does not need to acquire the tension T (k) at the k-th acquiring timing, and may acquire the tension at any timing from the (k−1)-th acquiring timing to the k-th acquiring timing. That is, the acquiring timing of the tension T (k) does not need to match with the acquiring timing of the feeding amount L (k).

The roll motor control portion 120 may weigh the plurality of tensions T (k) by other methods, instead of a method of collecting the multiple value of each tension T (k) and the feeding amount L (k) corresponding to the tension, and dividing the collected value by the total feeding amount Lt. For example, the roll motor control portion 120 collects the multiplied value of each tension T (k) and coefficient different in a plurality of stages in accordance with the corresponding feeding amount L (k), and divides the collected value by the total feeding amount Lt, and thus the plurality of tensions T (k) may be weighted.

In a case in which the roll motor control portion 120 controls the roll motor 33 at the time of the n-th feeding operation, the effective tension Te acquired at the time of previous feeding operation, for example, the effective tension Te (n−2) may be used as well as the effective tension Te (n−1) acquired at the time of the (n−1)-th feeding operation. That is, the "pre-feeding operation" is not limited to the previous feeding operation, and a concept of the previous and before the previous feeding operation is also included.

As an application example of the medium feeding apparatus of the invention, it is not limited to an ink jet type recording apparatus, and for example, a dot impact type recording apparatus, and an electro photo type recording apparatus may be used. Further, it is not limited to the recording apparatus, and for example, the medium feeding apparatus of the invention may be applied for a dry apparatus performing a dry process on a medium while the medium is fed, or a surface processing apparatus performing a surface processing on a medium while the medium is fed. In addition, it is not limited to an apparatus which performs such a process on the medium, and may be an apparatus which only feeds the medium.

This application claims priority under 35 U.S.C. § 119 to Japanese Patent Application No. 2016-053452, filed Mar. 17, 2016. The entire disclosure of Japanese Patent Application No. 2016-053452 is hereby incorporated herein by reference.

What is claimed is:

1. A medium feeding apparatus comprising:

a feeding portion comprising a feeding roller configured to apply a tension force to a medium to cause the medium to unwind from a roll body around which the medium is wound and configured to perform a feeding operation and a pre-feeding operation;

a roll driving portion configured to apply a torque in a medium unwound direction to the roll body to reduce the tension force applied to the medium and to help unwind the medium; and a roll control portion programmed to:

determine a distance of the medium fed based on an amount the feeding roller rotates, determine a diameter of the roll body based on Hall the distance of the medium fed and a number of rotations of the roll body caused by the distance of the medium fed, determine the torque that is to be applied to the roll body based on an effective tension calculated during a pre-feeding operation, such that a target tension is applied to the medium, during the pre-feeding operation, collect a plurality of tension values applied to the medium unwound from the roll body and a plurality of feeding amounts that the medium is fed during a plurality of time intervals, wherein each of the plurality of tension values corresponding to a feeding amount of the plurality of feeding amounts, and each of the plurality of tension values and each of the corresponding feeding amounts are collected at a same corresponding time interval; and calculate a weighted average of the plurality of the tension values, using each of the corresponding feeding amounts as the corresponding weight, the weighted average being the effective tension; and during the feeding operation, control the roll driving portion based on the effective tension.

2. The medium feeding apparatus according to claim 1, wherein the roll control portion weights the plurality of tension values by performing the following calculations:

for each tension value, multiplying the corresponding tension value and the corresponding feeding amount to generate a corresponding multiplied value, summing each multiplied value to generate a summed value, and dividing the summed value by a total amount of the plurality of feeding amounts.

* * * * *